US007810435B2

(12) United States Patent
Maier et al.

(10) Patent No.: US 7,810,435 B2
(45) Date of Patent: Oct. 12, 2010

(54) POWER REGULATION DEVICE FOR MODEL RAILWAY SYSTEM

(76) Inventors: Lawrence C. Maier, 137 Twitchell Hill Rd., New Haven, VT (US) 05472; Anthony R. Parisi, 402 Robbins Mtn. Rd., Richmond, VT (US) 05477

( * ) Notice: Subject to any disclaimer, the term of this patent is extended or adjusted under 35 U.S.C. 154(b) by 529 days.

(21) Appl. No.: 11/733,850

(22) Filed: Apr. 11, 2007

(65) Prior Publication Data

US 2007/0241726 A1 Oct. 18, 2007

Related U.S. Application Data

(60) Provisional application No. 60/790,827, filed on Apr. 11, 2006.

(51) Int. Cl.
*B61D 17/00* (2006.01)

(52) U.S. Cl. ..... 105/1.5

(58) Field of Classification Search ..... 105/1.4, 105/1.5; 246/20, 24, 218, 219
See application file for complete search history.

(56) References Cited

U.S. PATENT DOCUMENTS 6,356,423 B1 * 3/2002 Hastings et al. ..... 361/93.2
6,631,063 B2 * 10/2003 Ortiz et al. ..... 361/79
RE38,600 E * 9/2004 Mankovitz ..... 348/473
7,279,871 B2 * 10/2007 Pierson ..... 323/237

OTHER PUBLICATIONS

Paul Chandler, "Power Districts for Digital Command Wiring your DCC Layout with Circuit Breakers to Limit Operating Interruptions," Nov. 17, 2006, pp. 90-92, Kalmbach Publishing Co., www.modelrailroader.com.

* cited by examiner

*Primary Examiner*—S. Joseph Morano
*Assistant Examiner*—Robert J McCarry, Jr.
(74) *Attorney, Agent, or Firm*—Edell, Shapiro & Finnan, LLC

(57) ABSTRACT

A power regulation device and method for a model railway system is provided. The device comprises inputs that connect to a supply of a digital command control (DCC) waveform and to a track section to be powered by the DCC waveform. The device comprises a current measuring circuit that measures current flow associated with the DCC waveform supplied at the inputs. A switch is connected between the inputs and outputs that are in turn connected to respective rails of the track section. A controller is provided that analyzes a current measurement signal produced by the current measuring circuit and controls the switch to disconnect supply of the DCC waveform to the outputs when a true over-current condition is detected. The device may also comprise an auto-reversing function to accommodate reverse loop track sections.

27 Claims, 6 Drawing Sheets

POWER REGULATION DEVICE FOR MODEL RAILWAY SYSTEM

RELATED APPLICATIONS

This application claims priority to U.S. Provisional Application No. 60/790,827, filed Apr. 11, 2006, the entirety of which is incorporated herein by reference.

BACKGROUND OF THE INVENTION

Powered model railway systems (such as model railroads) that use a digital command control (DCC) signal are prone to short-circuit and overload conditions that interrupt operation of the railway system or damage expensive power supplies and/or electrical components. The potential for track shorts increases as the number of operators on a system increases. Several solutions have been proposed to address the problem of track short circuits. Ballast lamps, relays, and kill switches have been used with limited success.

Some overloads conditions are caused by large capacitors used in sound system decoders. The overload condition appears as a short circuit until the capacitors in the decoders are charged. These types of overload conditions are short-lived and do not cause harm to other equipment.

The problem is that all good power supplies, whether conventional DC, DCC-based, or AC, have built in circuit protection that senses a short and shuts down all the power in about 0.25 second. The above-mentioned approaches, while protecting the power supply, shuts down all activity on the railway system until each and every operator resets their locomotives.

What is needed is a device that can determine if the overload condition is caused by a true short circuit in the system or just a temporary overload.

SUMMARY OF THE INVENTION

Briefly, a power regulation device and method for a model railway system is provided. The device comprises inputs that connect to a supply of a digital command control (DCC) waveform and to a track section to be powered by the DCC waveform. The device comprises a current measuring circuit that measures current flow associated with the DCC waveform supplied at the inputs. A switch is connected between the inputs and outputs that are in turn connected to respective rails of the track section. A controller is provided that analyzes a current measurement signal produced by the current measuring circuit and controls the switch to disconnect supply of the DCC waveform to the outputs when a true over-current condition is detected. The device may also comprise an auto-reversing function to accommodate reverse loop track sections. The controller is capable of distinguishing temporary surges from true over-current conditions that warrant tripping the circuit breaker function of the device. The power regulation device according to the present invention may also be designed to receive a power input consisting of a 50 or 60 Hz AC waveform as may be found in the operation of some train systems (e.g., model trains known under the brand name Lionel). Since these systems do not incorporate provisions for the use of DCC signals, functions that require these signals may not be available on a model railroad that uses 60 Hz power.

DETAILED DESCRIPTION

Figure 1:
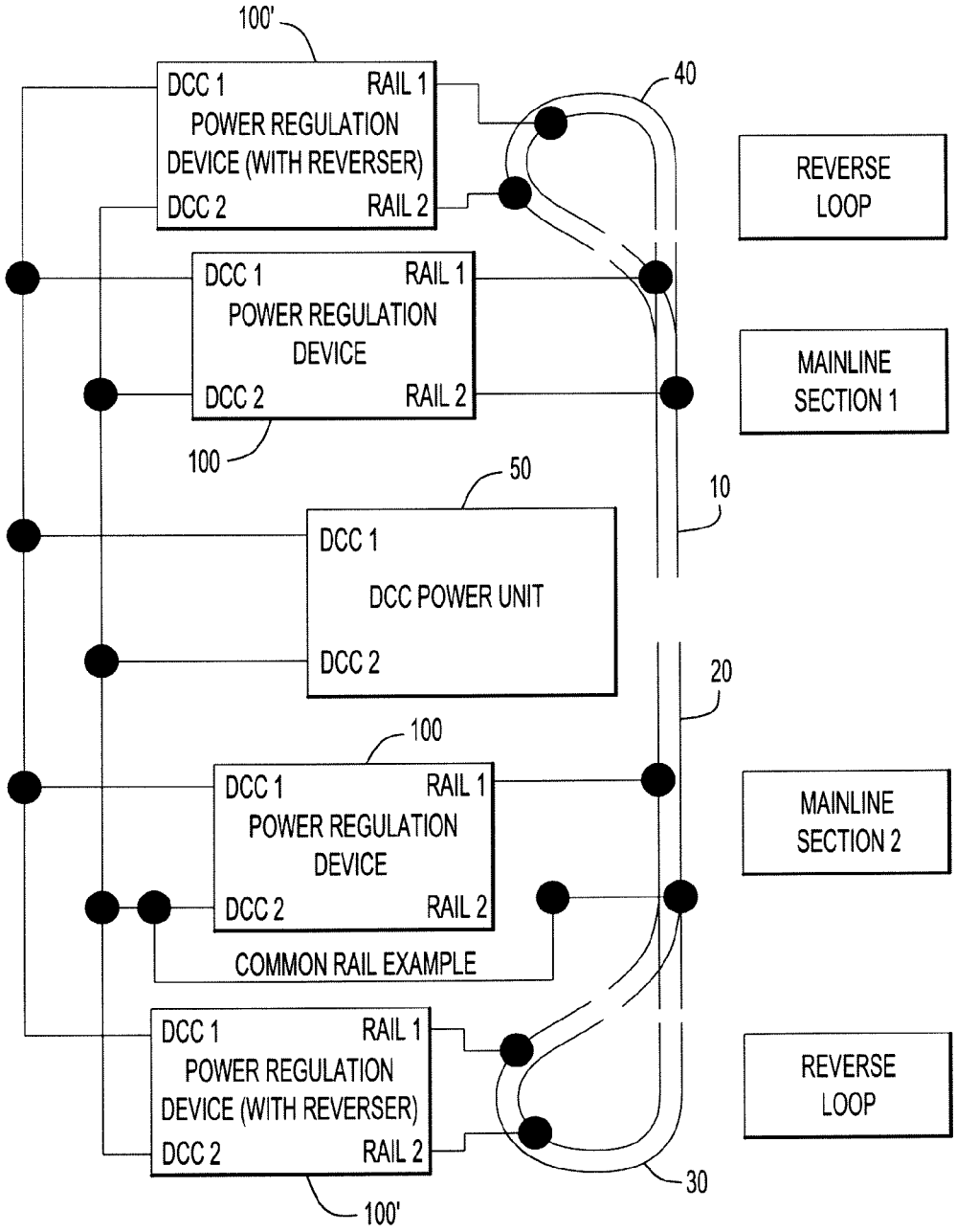
FIG. 1 illustrates a block diagram of an exemplary railway system that employs the power regulation device according to embodiments of the present invention.

FIG. 1 illustrates a schematic diagram of an exemplary model train/railway system in which including the power regulation device of the present invention may be used. The power regulation device is shown at reference numerals 100 and 100', where power regulation device 100' has all of the power management functions of device 100, but also has auto-reversing functions. A power shield device 100 connects to respective mainline track sections 10 and 20, whereas a power regulation device 100' connects to respective reverse loop track sections 30 and 40. The power regulation devices 100 and 100' each have first and second (differential) input terminals that connect to the first and second output terminals of a digital command control (DCC) power unit 50. The power unit 50 outputs differential DCC signals DCC1 and DCC2. The power regulation devices also have first and second output terminals that connect to respective rails of their associated track sections as shown in FIG. 1.

For simplicity the layout shown in FIG. 1 has only two mainline track sections 10 and 20 and two reverse loop track sections 30 and 40. It should be understood that an actual layout may have more than two mainline (non-reversing) track sections, each of which may be protected with the power regulation device of the present invention. The power regulation devices 100 and 100' perform an intelligent circuit breaking function that is activated when a short-circuit type of conditions occurs in a given district that is detected by one of the devices 100 and 100'. Thus, the power regulation devices 100 and 100' are operable to prevent shutdown of the other parts of the layout when an overload condition occurs within their associated section. Between adjacent mainline sections the differential signals DCC1 and DCC2 must be kept on the same rail to prevent shorting the DCC power unit (and tripping the breaking function of the devices 100 and 100') as a train passes from one track section to the next.

Moreover, the layout shown in FIG. 1 includes only two reversing sections 30 and 40, but it should be appreciated by those with ordinary skill in the art that a layout may have several more reversing sections. The power regulation devices 100' provide a circuit breaker function (to isolate faults) within its track section, as well as to provide track reversal. On the layout illustrated in FIG. 1, a fault on any section of the layout would be isolated from all other sections. Track reversal is provided as traffic moves around the two reverse loops. All this is provided from a simple DCC power unit (needs no built-in reverse function). The devices 100 and

100' may include on-board visible indication of a trip and/or indication of track reversal (in the case of the reverser), with provision for activating a remote visible indication as well.

Some overloads conditions are caused by large capacitors used in sound system decoders. The overload condition appears as a short circuit until the capacitors in the decoders are charged. These types of overload conditions are short-lived and do not cause harm to other equipment. The power regulation devices 100 and 100' are capable of distinguishing an overload condition caused by a true short-circuit condition in the DCC system for which the circuit breaking function is activated as opposed to a temporary overload condition for which the circuit breaking function is not activated.

The circuit breaking function of the power regulation devices 100 and 100' may be coordinated with switch machines or reversing units (such as those sold by MRC, AD520, Lenz, LK100 & Digitrax PM4). The circuit breaking function may be automatically reset a predetermined period of time after it was tripped, or it may be manually reset. The device 100 and 100' may include visible indicators of status conditions (as well as provisions for a remote visible indicator), an over-voltage feature to protect decoder burn-out resulting from DCC power unit malfunction, and/or over-current trip time adjustments using jumpers. Thus, devices 100 and 100' provides over-current and over-voltage protection, sectionalized with respect to the connected track section and thereby prevent shutting down other parts of a layout when a track section is subjected to an over-current condition. The power regulation device 100' includes all of the features and functions of the device 100 but also provides auto-reversing for return loops, reversing Y's and turntables.

Figure 2:
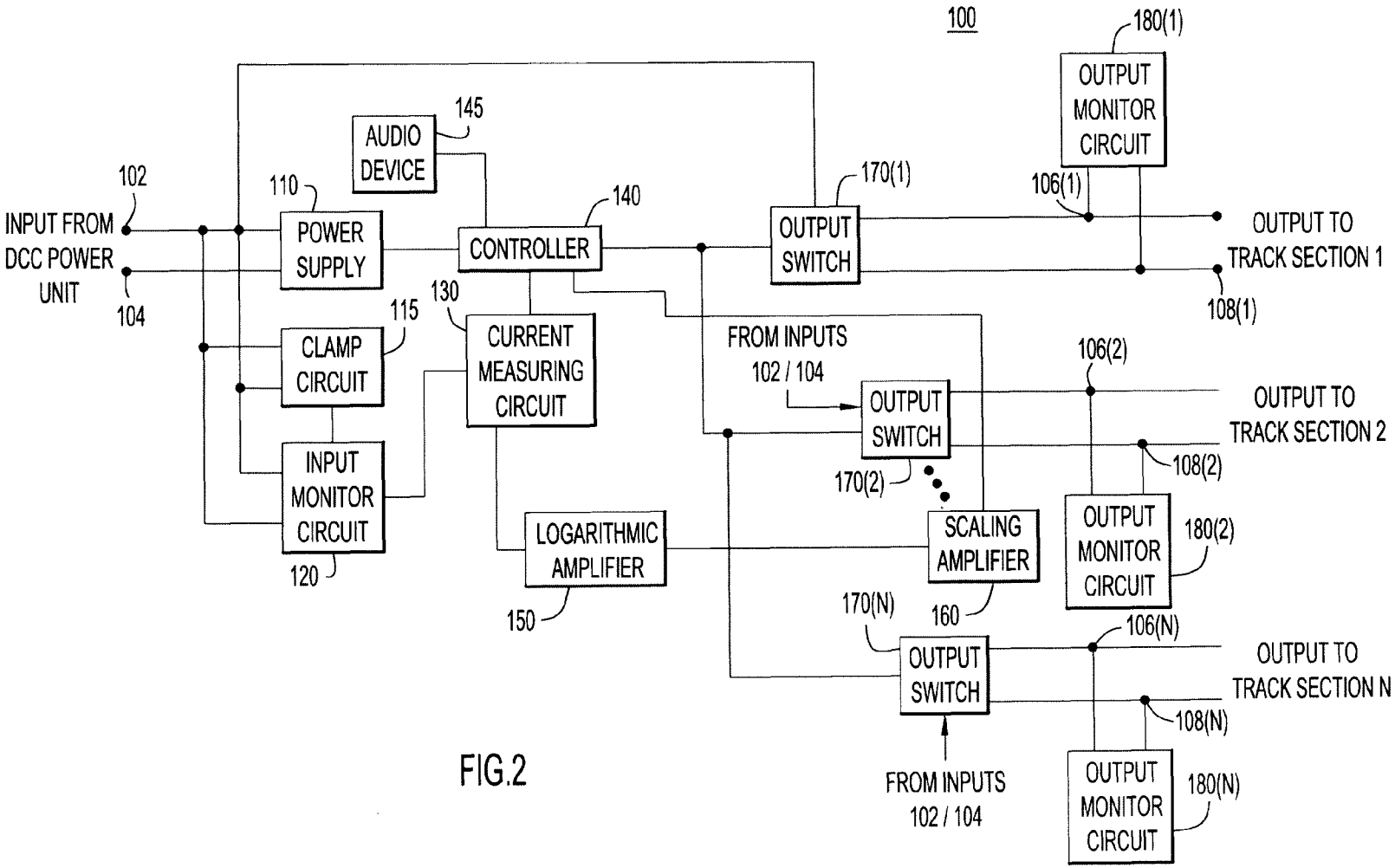
FIG. 2 is a block diagram of a power regulation device according to a first embodiment of the invention.

Turning to FIG. 2, a block diagram of a power regulation device 100 is shown. The power regulation device 100 comprises first and second input terminals 102 and 104 that connect to the DCC1 and DCC2 outputs of the DCC power supply/booster 50 (FIG. 1) and first and second output terminals 106 and 108 that connect to respective rails of a track section. The input terminals 102 and 104 connect to a power supply circuit 110, a clamp circuit 115 and an input monitor circuit 120. The power supply 110 generates power for various components of the device 100, as well as to power the device 100 when there is a loss of DCC input power when short-circuit conditions are detected a processed. The input monitor circuit 120 is connected to a current measuring circuit 130 that measures the level of current in the device 100 from the input terminals 102 and 104. The current measuring circuit 130 produces a current measurement signal that represents a measured current and this current measurement signal is connected as an input to a controller 140. The controller 140 performs the control functions for the device 100 and may take the form of a microprocessor with onboard memory that stores control parameters and logic in connection with the control functions. A logarithmic amplifier 150 is connected to the current measuring circuit 150 and a scaling amplifier 160 is connected to an output of the logarithmic amplifier 160. An output of the scaling amplifier 160 is connected as an input to the controller 140.

The power regulation device 100 may be used to control delivery of DCC power to one or to each of a plurality of track sections. To this end, the device comprises one or more output switches 170(1) to 170(N) depending on the capability built into the device. Each output switch 170(1) to 170(N) is connected to connected to the input terminals 102 and 104 to connect or disconnect DCC power to and from the output terminals 106(*i*)/108(*i*) of a corresponding track section (i), for i=1 to N. Output switch 170(1) controls connection of DCC power to output terminals 106(1)/108(1) that connect to respective rails of track section 1, output switch 170(2) controls connection of DCC power to output terminals 106(2)/108(2) that connect to respective rails of track section 2, . . . , and output switch 170(N) controls connection of DCC power to output terminals 106(N)/108(N) that connect to respective rails of track section N. All of the track sections controlled by the same power regulation device may be part of the same power district. The concept of a power district is described hereinafter.

Normally, each of the output switches 170(1) to 170(N) connects the DCC power from the input terminals 102 and 104 to its associated output terminals. The controller 140 monitors the conditions of the track section and of the DCC waveform at input terminals 102 and 104 to determine when a true overload conditions exists justifying a circuit breaking function whereby it asserts a trigger or trip signal that is coupled to each of the output switches 170(1) to 170(N) causing them to assume an open-circuit or isolated state whereby the DCC power at the input terminals 102 and 104 is disconnected from the output terminals 106 and 108 connected to the associated track section. Other conditions under which the controller 140 may assert the trigger signal are described hereinafter. An audio alert device 145 may be provided that is activated when the controller 140 trips a break condition.

As an option, there may be an output monitor circuit 180(*i*) associated with each output switch 170(*i*) (for i=1 to N) to monitor the signals connected to the respective rails of a corresponding track section.

Turning to the schematic diagram of FIG. 3, the power regulation device 100 will be described in greater detail according to one embodiment of the invention. The power supply circuit 110 is connected to the first and second input terminals 102 and 104 and comprises a voltage regulator integrated circuit (IC) 112, series connection of a resistor R9 and diode D5, a capacitor C6 connected between one terminal of the diode D5 and the input terminal 104. The diode D5 rectifies the incoming DCC voltage, while the capacitor C6 filters the resulting half-wave DCC waveform. The capacitor C6 is sized to store enough charge to operate all of the functions of the device 100 for a short period of time, for example, 0.1 seconds after loss of any DCC input power. This is necessary because there may be no voltage available while short circuits are detected and processed by the device 100.

The clamp circuit 115 is connected to the input terminals 102 and 104 and comprises a clamp diode D11. The clamp diode D11 prevents voltage spikes from passing through the device 100 that could potentially damage equipment connected to the device 100. In addition, the clamp diode D11 ensures that any track sections connected to it is also protected from this damage.

The input monitor circuit 120 is connected to the input terminals 102 and 104 and to the clamp circuit 115. The input monitor circuit 120 comprises network of diodes D12, D13 and D16, where diode D12 is a light emitting diode (LED) to provide a visual indication on the device 100 when DCC input power is applied and connected to the device 100. The diodes D13 and D16 work to limit current through the diode LED D12 to an acceptable value during one phase of the input voltage, and to limit current in the reverse direction for a LED in a remote device connected to the device 100 that mirrors the state of the diode D12.

The current measuring circuit 130 comprises a transformer T2 connected to input terminal 104 to sense current flow through the unit. The current flow in the primary of transformer T2 produces an output voltage in the secondary across resistor R22 that is proportional to the current. A Zener diode Z6 is provided that is connected to one terminal the secondary of transformer T2 and to a node between resistors R18 and R21. The Zener diode Z6 clamps the output voltage of the transformer T2 to approximately 0 volts minimum and 5.6 volts maximum to prevent damage to following circuitry. Through resistor R21 the output of Zener diode Z6, referred to herein as a current measurement signal, is connected to the controller 140 where it is compared with a software controlled and programmable trip limit. This function is described in further detail hereinafter.

The logarithmic amplifier 150 is connected to an output of the current measuring circuit 130. The logarithmic amplifier 150 comprises diodes D9 and D10 connected in parallel with each other and with a resistor R28. These parallel-connected components are connected in a feedback circuit of an operational amplifier (op-amp) 152. The input of the op-amp 152 is connected to a second output from the transformer T2 of the current measuring circuit 130 via an AC-coupling capacitor C7. The other input of the op-amp 152 is connected to approximately half of the supply voltage via resistor R26. The voltage across a diode is known to be related to the natural logarithm of the current through the diode. The logarithmic amplifier uses two diodes D9 and D10 back to back as the feedback gain element of the op-amp 152. The logarithmic amplifier 150 generates a peak to peak output voltage that is proportional to the natural logarithm of the input current supplied via transformer T2 of current measuring circuit 130. The output voltage of the op-amp 152 is therefore proportional to the natural logarithm of the input voltage, and the input voltage is proportional to the current flowing through the primary of transformer T2 in the current measuring circuit 130. Thus, the output voltage of the op-amp 152 is proportional to the natural log of the transformer T2 primary current. The value of the input current is measured over several decades of current magnitude in a range from about 5 mA to 100 amperes in order to discriminate a decreasing current such as caused by a capacitor charging from an approximately steady current as may be caused by a short circuit.

The scaling amplifier 160 comprises an op-amp 162 having a parallel combination of a resistor R24 and capacitor C8 connected in its feedback circuit. One input of the op amp 162 is connected to the output voltage of the logarithmic amplifier 150. The op-amp 162 scales the output voltage of the logarithm amplifier 150 to a convenient ratio, for example, such that 100 amperes produces approximately 4.5 volts peak to peak at the input to the controller 140.

Figure 3:
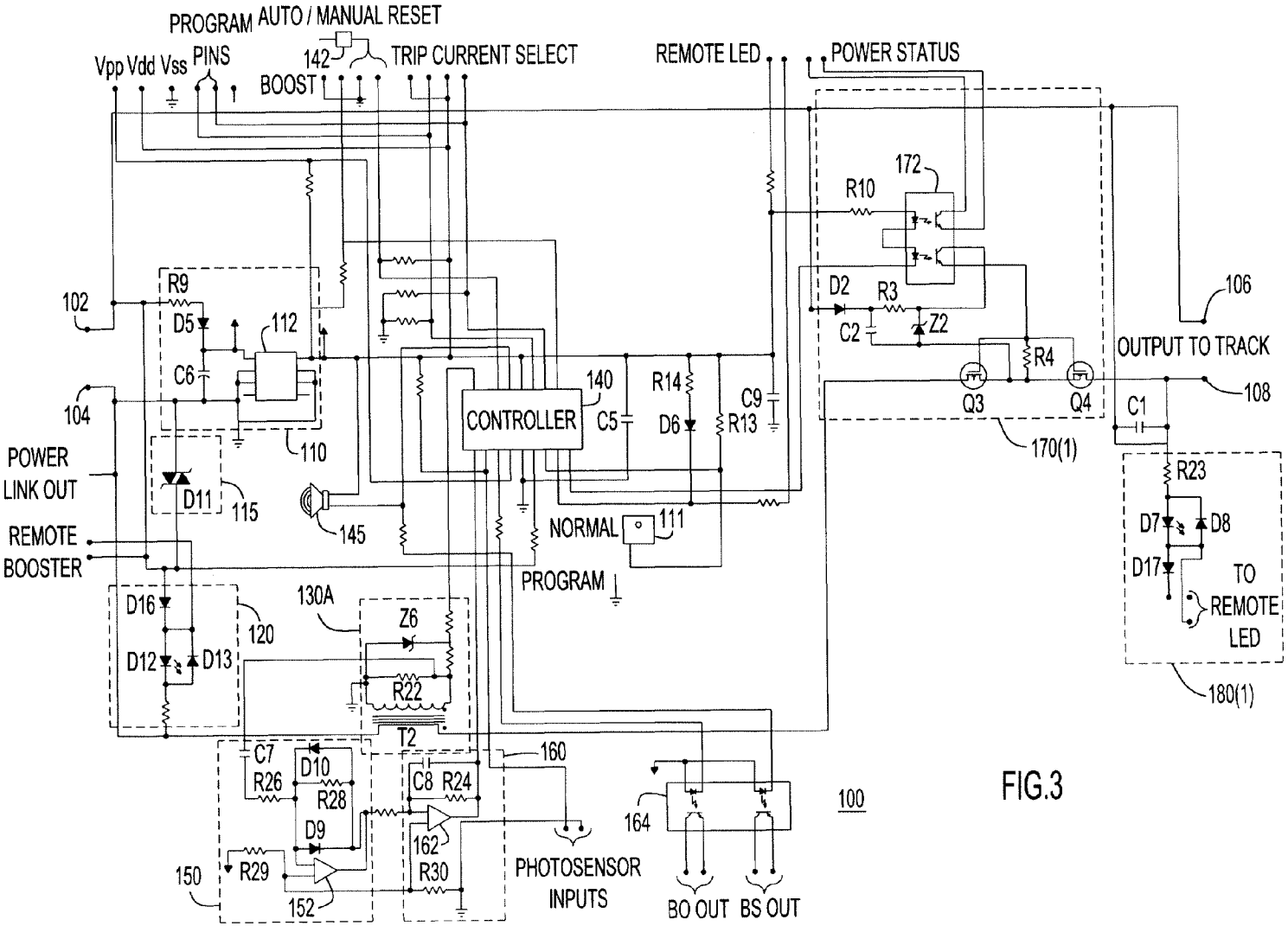
FIG. 3 is a schematic diagram of the power regulation device shown in FIG. 2.

In the schematic diagram of FIG. 3, only a single output switch 170(1) and a single output monitor circuit 180(1) is shown for simplicity. However, as explained above in connection with FIG. 2, there may be a plurality of identical output switches 170(1) to 170(N) (each with a corresponding output monitor circuit) in the device 100. The output switch 170(1) comprises an optical coupler 172, diode D2 and Zener diode Z2, two metal oxide field effect transistors (MOSFETs) Q3 and Q4, resistors R3 and R4 and a capacitor C2. The input terminal 104 is coupled, via the transformer T2 in the current measuring circuit 130, to the drain of MOSFET Q3. Likewise, the input terminal 102 is connected to diode D2 which is turn connected to the capacitor C2, and is also connected to the output terminal 106. The Zener diode Z2 is connected between one end of resistor R2 and the capacitor C2 and that node of the capacitor is connected between the MOSFETs Q3 and Q4. The resistor R4 is connected at one end to a node between the transistors Q3 and Q4 to terminal of the optical coupler 172. The transistor Q4 is also connected to the output terminal 108.

In operation, the capacitor C2 is charged via diode D2 and the bulk diode of MOSFET Q3 when input terminal 102 is positive with respect to input terminal 104 and the capacitor C2 stores charge when the polarity of input terminals 102 and 104 is reversed. Since the DCC signal at terminals 102 and 104 is constantly reversing direction, the capacitor C2 remains charged continuously. The Zener diode Z2 limits the voltage available from capacitor C2 to about 12 volts while resistor R3 limits the Zener current to a value within the rating of the Zener diode. When the optical coupler 172 is off, then resistor R4 holds the gate voltage of MOSFETs Q3 and Q4 at 0 volts and the output switch 170 is therefore off. When the optical coupler is turned on, the output transistor in the optical coupler 172 turns on, consequently connecting the gates of MOSFETs Q3 and Q4 to the voltage of capacitor C2, thus turning on the two MOSFETs Q3 and Q4. In this manner, the optical coupler 172 turns MOSFETs Q3 and Q4 on and off while keeping the output circuit 170 isolated from the control circuits. MOSFETs Q3 and Q4 are connected in a source-to-source configuration. When both transistors Q3 and Q4 are on, they can conduct current in either direction. When they are both off, they can block voltage in both directions. The source-to-source configuration therefore allows MOSFETs Q3 and Q4 to turn the DCC power waveform (which is an alternating waveform) on and off simply by turning the optical coupler 172 on and off. Thus, a trigger signal generated by the controller 140 and supplied to the optical coupler 172 turns the optical coupler 172 off and thus disconnects the DCC waveform from the output terminals 106 and 108.

The output monitor circuit 180(1) comprises a diode network consisting of an LED D7 connected in parallel with a diode D8. A diode D17 connects to one terminal of the LED D7 and to an output terminal for a remote track monitoring device. LED D7 indicates when the track voltage (DCC power) is on or off and the output monitor circuit 180(1) operates in much the same way as the input monitor circuit 120 including the ability to have a remote LED mirror the status of LED D17.

The controller 140 may be a microcontroller, such as a FLASH-based 8-bit microcontroller, that is programmable to provide the circuit breaker and other functions of the device 100. One function of the controller 140 is to compare a signal representing the current measured by the current measuring circuit 130 with a programmable trip limit value. When the measured current is greater than the trip limit value, the comparator function of the controller generates a trigger signal (e.g., a signal indicating that the over-current condition is "true") to initiate the circuit breaking sequences of the controller 130. As discussed above, a linear representation of the measured current is used to trip the breaker function of the device 100 (and for the reverser function of device 100). In this case, the controller 140 compares a voltage analog of the measured current to the programmable trip limit stored in the memory of the controller 140. When the voltage exceeds the stored trip limit value, a short is detected and the trigger signal is supplied to the output switch 170(1) to cause the output switch 170(1) to disconnect from the output terminals 106 and 108 thereby disconnecting the DCC power from the output terminals.

When the device 100 is off, it must turn on in order to operate. Many of the loads associated with DCC systems have a very high surge current (due to filtering capacitors or incandescent light bulbs (among other causes)) when the output of the device 100 is turned on. Thus, when the controller 140 first turns the output back on, the current comparator function may exhibit a true (excess current) output state. In conventional breaker systems, this excess current will then trip the breaker and turn the output off. The result is that a conventional breaker device cannot turn the output on when these heavy surge loads are present. In the devices 100 and 100' of the present invention, a so-called "smart turn on" function is provided using the capabilities of the logarithmic amplifier 150 to overcome this problem. A software program is stored in the controller 140 to use both the state of the current comparator and the output of the logarithmic amplifier 150 to determine if the output should be held on or turned off each time there is a command to turn the output on. Since the logarithmic amplifier 150 can measure current over several magnitude intervals ("decades"), the controller 130 can analyze the behavior of the current when the output is turned on even when a very high current is present due to a short circuit condition. When the current is very high but is decreasing in value, then the controller detects the load as a temporary surge load and does not trip the output switch 170(1) to open so that the output at the output terminals 106 and 108 is kept on. However, when the controller 130 determines from the output of the logarithmic amplifier 150 that the load is a high but constant value (does not decrease over time), then the controller 130 determines that it is a true over-current situation and trips the output switch 170(1) to open thereby turning the output off.

There are two reset modes for the device 100. In the automatic reset mode, the controller 140 automatically attempts to reset the output switch(es) after a programmable period of time, e.g., two seconds. If after resetting the output switches the controller 140 determines, through analysis of the current measurement signal and output signal from the natural logarithmic amplifier 150 that there is still an over-current problem, the controller will trip the circuit breaking function by opening the output switch(es). The controller 140 is programmed to use the automatic reset mode by keeping the two terminals or pins labeled "auto/man reset" in FIG. 3 open. Thus, the controller 140 may be programmable to automatically attempt to reset the output switch a programmable period of time after controlling the first switch circuit to disconnect the first and second output terminals from the first and second input terminals.

The manual reset mode is established by shorting those two terminals together with a reset switch (e.g., pushbutton switch), for example, shown at reference numeral 142. When the two "auto/man reset" terminals are shorted together, the controller 140 will not attempt to reset the output switches until the short between the terminals is opened by, for example, pushing the pushbutton. The controller 140 monitors the status of the reset switch via the terminals it connects to and attempts to reset the output switch(es) only when the reset switch 142 is activated or closed. The reset will be successful unless there is still an over-current condition present.

As part of the turn on function, the controller provides a low current system boost function. Control systems with low current capability often cannot provide enough energy to charge up surge loads before their own internal protection turns them off. For these systems, the device 100 is provided with a jumper or memory location can enable a boost function. The controller 140 initiates the boost function at the Boost terminals to turn the output on for a short time to start the surge load charging to external devices that are connected to terminals the Boost terminals, and then turns the output off for a short time to allow the low current system to recover. The controller 130 then executes its normal smart turn on routine described above. This sequence allows low current systems to start a heavier surge load than they would normally be able to start by themselves while still maintaining protection from short circuits.

As shown in FIG. 3, the device 100 has Block Occupied (BO Out) and Block Shorted outputs (BS Out) for use by other systems via an optical coupler 164. The output transistors in the optical coupler 164 are turned on when the associated condition (block occupied or block shorted) is true. The "Block Shorted" condition is simply the conditions under which the controller 140 trips the output switch 170(1) to open circuit. The controller 130 uses the output of the logarithmic amplifier 150 to perform a block occupied function. Since the logarithmic amplifier 150 can sense very low currents (e.g., less than 5 mA), the controller 130 may be programmed with a limit value such that if the current is less than the limit, a "block occupied" output is turned off or disabled. On the other hand, when the current from the logarithmic amplifier is greater than the limit, the controller 130 turns on or enables the block occupied output. The block occupied output (BO Out) is shown taken from the controller 140 through an optical coupler 164. For the low currents useful for the block occupied function, the output of the logarithmic amplifier 150 output is approximately linear with current.

The output of the controller 140 that drives BS Out also has provision for activating the sound alerting device 145 that may be an externally supplied or connected device. When a sound alerting device 145 is installed, the controller 140 will activate it to emit an audible sound whenever the outputs of the device 100 are off due to a short circuit in the system.

The device 100 also has an input for an external photo-resistive cell used in model railroad systems to detect presence of a train at a track section. A photo-resistive cell typically has a low resistance (about 2K ohms) when light is shining on it and a high resistance (greater than 200K ohms) when it is dark, i.e., blocked by an object. When connected to the device 100, the photo sensor normally does not cause any change in the operation of the device. However, if a DCC accessory command, such as a command in accordance with the national model railroad association (NMRA) is used to arm the photo sensor, then a software module in controller 140 measures the average level of illumination on the photo sensor, via the inputs shown in FIG. 3, and sets a trip point slightly above this value. When the photocell is covered or blocked by an object, the light level decreases, the resistance associated with the photo-sensor increases, and the trip point in the controller 140 is exceeded. This condition causes the controller 140 to turn off the output switch 170(1) and the controller 140 will keep the output switch off until it is turned on by a NMRA DCC accessory command. The photo sensor will again be disarmed until given a new arming command. In this manner, a train that is out of view of an operator can be stopped at a specific location by placing a photo sensor in an inconspicuous location between the rails near that location. When the photo sensor is armed, the controller 140 will turn off the power to the controlled section of track when a train just covers or blocks the photo sensor. Thus, a train can be made to stop at a specific spot even if it is not directly viewable. Since the photo sensor automatically disarms itself when it trips, the train can be moved later by simply issuing a NMRA DCC accessory command to turn the device 100 on again. As a second option, a programmable memory location can cause the block occupied output to be true anytime the photo sensor is covered or blocked by an object, thus not requiring it to be armed by a DCC accessory command.

The controller 140 may also be responsive to a DCC command contained in the DCC waveform that causes the controller 140 to automatically trip the breaker by generating the trigger signal that causes the output switch(es) to disconnect the DCC waveform from the output terminals. Similarly, the controller 140 may be responsive to a DCC command contained in the DCC waveform that causes the controller 140 to automatically attempt to reset the output switch(es). Thus, in this way, the controller 140 can be controlled by appropriate DCC commands to control the status of the output switches independent of whether or not there is an over-current condition, or other condition, warranting control of the output switch(es).

Diode D6 is an LED that is used to provide status information about the operation of the controller 140. Diode D6 is normally off if the controller has turned the output switch 170(1) on. This condition indicates normal operation with power supplied to the track. If the output switch 170(1) is turned off, either due to a short circuit or a NMRA DCC command, then diode D6 can be turned on to alert the operator that power has been removed from the track. In the case of the device 100' with the auto-reversing function, diode D6 can be flashed on and off to indicate that the output on 106 and 107 is the reverse of the input on 102 and 103. When the operator is changing memory values to custom configure the device as discussed below, the diode D6 can be flashed to indicate that the programming operation is successful.

Access to the memory locations that define the accessory addresses for the various programmable functions and to memory locations that allow the user to custom configure the device is provided by the program jumper unit 111. When a jumper is at the Normal position of unit 111, the device 100 operates normally. When the jumper is moved to the Program position of unit 111, the addresses and configuration variables can be programmed as desired by the user. Connectors labeled "program pins" provide the ability to change the software program of the controller 140 if desired.

Programming the Power Regulation Device 100

The controller 140 in device 100 may have one or more accessory addresses. The first accessory address may let a user turn the output track power from the device on and off. The second address may be used to arm the photo sensor for the functions described above. The third address may be used to operate the switch machine portion of the auto-reverse version of the device. Addresses are set by moving a program jumper 111 to the position labeled "program" with power off By default when power is turned on, the unit will store the next address received as the first address. Once the first address is entered, the unit will automatically store the second and third address as the first and second sequential values following the first address. If a second address is issued from the NMRA DCC controller, then it is stored as the second address. If a third address command is issued, then it is stored as the third address. Thus, it is possible to have up to three sequential addresses starting at any desired address, or to have up to three random addresses.

The device 100 may be programmed by moving jumper 111 to the "Program" position and connecting inputs 102 and 104 to the output of a DCC system. There is a red LED, D6, on the device 100 that will blink each time a command is accepted. There is also an LED near the power input, D13, that may be used to verify the presence of the DCC signal while programming the device 100. Examples of programmable parameters are as follows:

CV49—Sets the current trip limit value used by the comparator function of the controller 140 described above. If CV49=00, then the pins labeled "trip current select" are enabled by which the trip current value can be programmed according to how these pins/terminals are connected together to yield a program a variety of values.

Alternatively, a range of values for CV49 (01 to 15, for example) may be programmed to cover a range of trip current values from approximately 1.2 A to 19.1 A. The default current trip value is 3.81 Amps.

CV50 is the block detection source selection. CV50=0 selects block current as the parameter to activate the Block Occupied (BO Out) output. CV50=1 uses the external photo sensor to activate the BO Out output when the photo sensor is covered.

CV51 is not used.

CV53 enables or disables the weak system boost feature described above.

CV53=0 disables the boost unless the weak system boost jumper is installed. Any other value enables the boost regardless of the presence or absence of a jumper on the terminals labeled Boost.

CV54 sets current level at which the detector turns on to indicate the block is occupied. Values range from 0 to 212. This allows a user to set a level above the leakage current on track to allow detection of block occupancy when other devices (e.g., switch machines) may draw current from the block.

CV55-CV62 are not used.

CV63 allows control of the address programming point. Setting a value of 42 to CV63 will cause the circuit breaker to set all CVs and addresses to factory defaults. The CV63 default is 0.

As mentioned above, the period of time that the controller 140 waits after tripping the breaking function and before attempting a reset may be programmable at an appropriate memory location in the controller.

Figure 4:
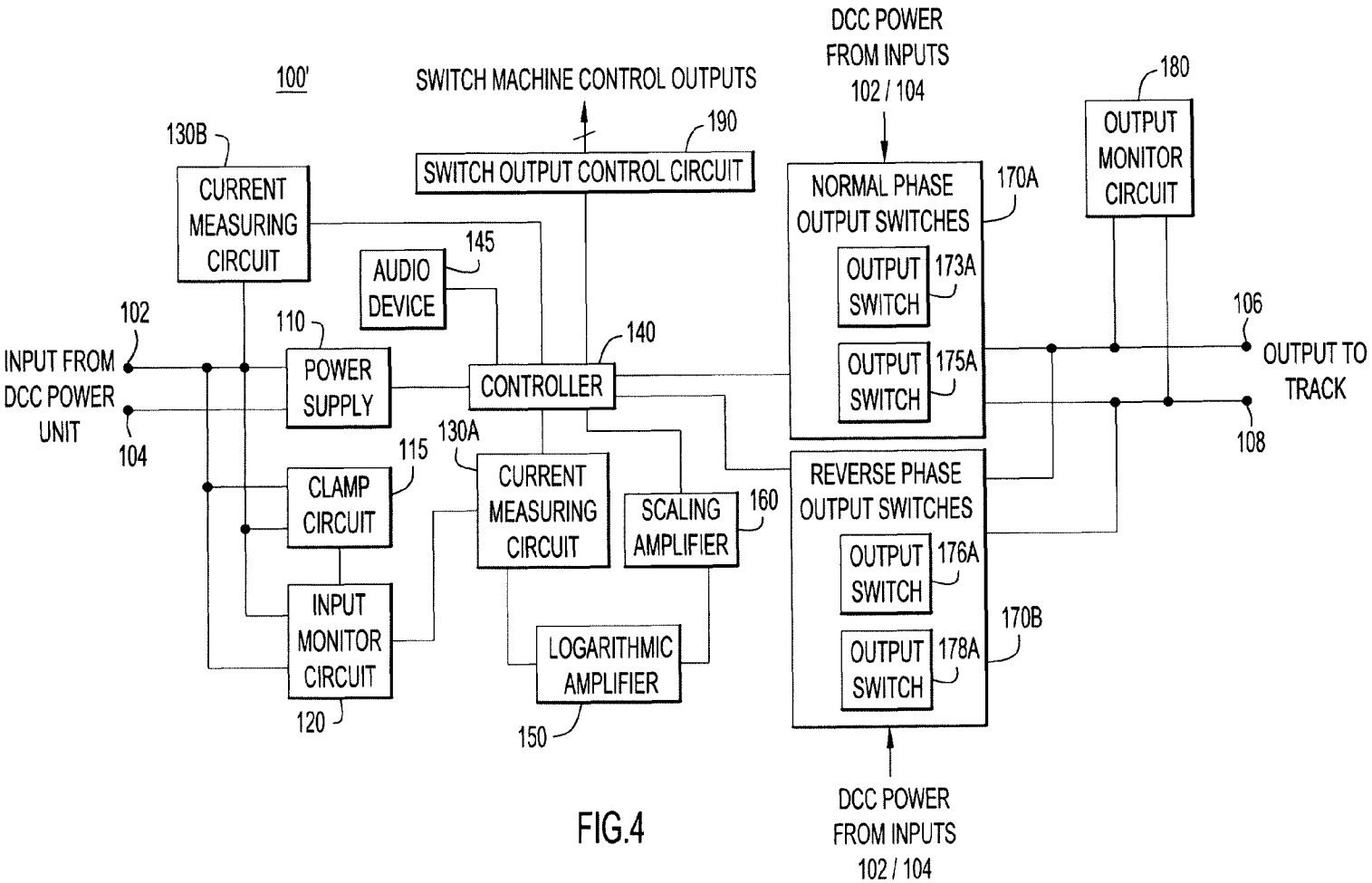
FIG. 4 is a block diagram of a power regulation device according to a second embodiment of the invention.

FIG. 4 illustrates a block diagram of the power regulation device 100'. The device 100' is similar in many respects to device 100 except that it has first and second current measuring circuits 130A and 130B and two output switch circuits 170A and 170B. In addition, the device 100' comprises a switch output control circuit 190. The normal phase output switch circuit 170A comprises switches for controlling normal phase switching and the reverse phase output switch 170B comprises switches for controlling reverse phase switching. Each of the output switch circuits 170A and 170B is connected to receive the DCC waveform from the input terminals 102 and 104 and is connected to the output terminals 106 and 108. Output switch circuit 170A comprises a pair of output switches 173A and 175A and output switch circuit 170B comprises a pair of output switches 176B and 178B. Output switches 173A, 175A, 176B and 178B are each identical to the output switch 170(1) shown in FIG. 3, and therefore are not described in detail here.

The normal phase output switch circuit 170A turns the DCC waveform on and off at the output terminals 104 and 106 in phase with the DCC waveform at the input terminals 102 and 104. The reverse phase output switch circuit 170B turns the DCC waveform on and off at the output terminals 104 and 106 in reverse (opposite) of the phase of the DCC waveform at the input terminals 102 and 104. This configuration allows the controller 140 to control the phase of the output such that it matches the phase of the track section required to eliminate a short-circuit condition due to a reversing loop. The switch output control circuit 190 generates signals for use by an external switch machine device to track the phase of the DCC power coupled to the output terminals 106 and 108.

Figure 5:
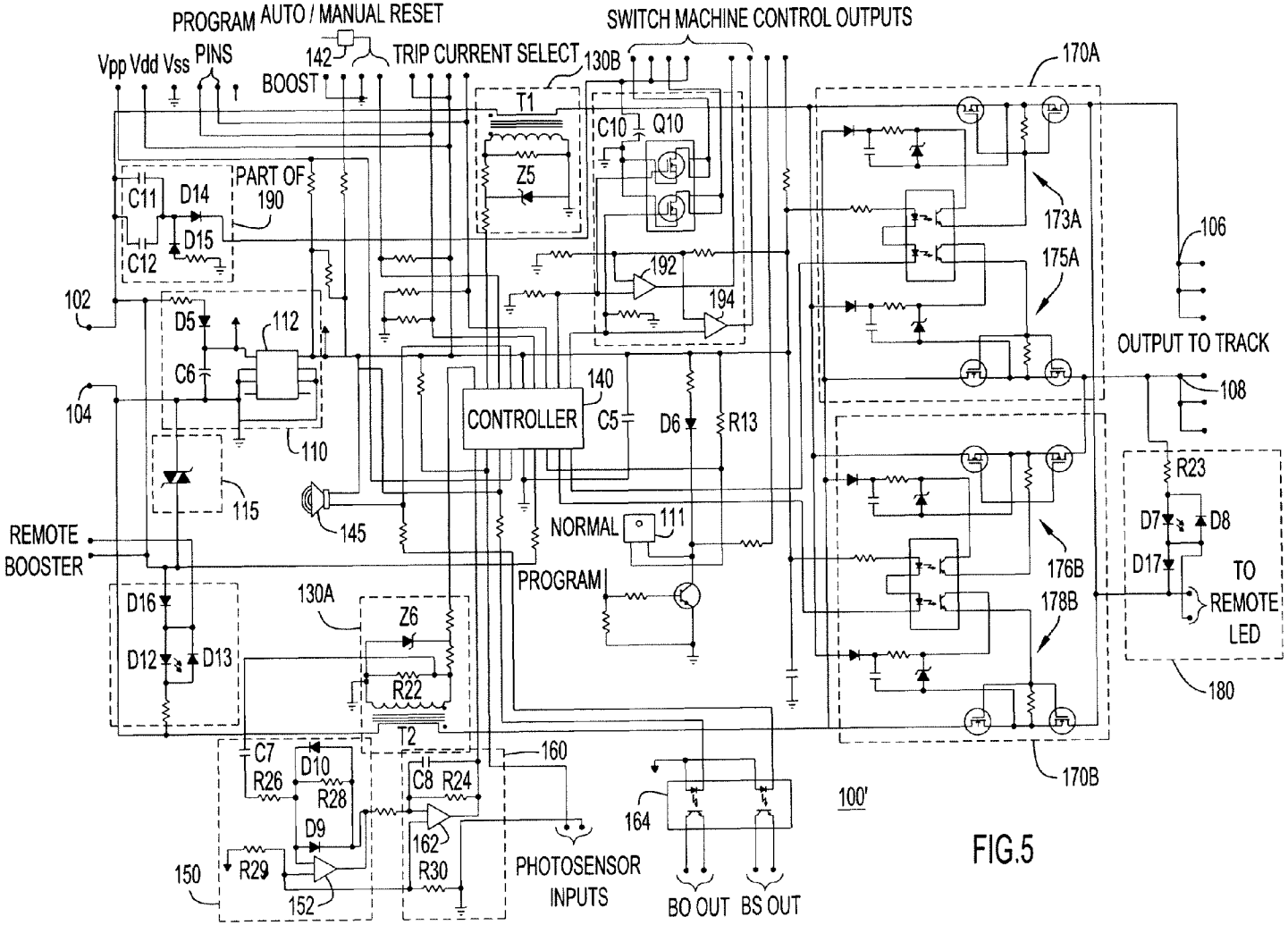
FIG. 5 is a schematic diagram of the power regulation device shown in FIG. 4.

Referring now to FIG. 5, a schematic diagram of the power regulation device 100' is shown. Again, the power regulation device 100' is similar to device 100 except that device 100' is designed to handle reversing functions whereas the device 100 is not. The power supply circuit 110, clamp circuit 115, input monitor circuit 120, logarithmic amplifier 150, scaling amplifier 160 and output monitor circuit 180 are identical to the similarly named circuits in FIG. 3. The first and second current measuring circuits 130A and 130B are both identical to the current measuring circuit 130 in FIG. 3. The first current measuring circuit 130A measures the current flowing form the input terminal 104 whereas the second current measuring circuit 130B measures the current flowing from the input terminal 102. There are two current measuring circuits in the device 100' due to its reversing functions. In some track configurations, the short circuit current that triggers the reversing function will only flow in one or the other of the wires connected to input terminals 102 and 104. For this reason, it is necessary to sense current in both current paths through device 100' using the first and second current measuring circuits 130A and 130B. The first current measurement signal produced by the first current measuring circuit 130A is the same as the current measurement signal produced by current measuring circuit 130 in FIG. 3 and represents a measure of current flowing from the input terminal 104. The second current measurement signal produced by the second current measuring circuit 130B represents a measure of current flowing from the input terminal 102.

The normal phase output switch circuit 170A comprises the two output switches 173A and 175A both of which are identical in structure to the circuitry of the output switch 170(1) shown in FIG. 3. Output switch 173A controls the connection of DCC input power to output terminal 106 and output switch 175A controls the connection of DCC input power to output terminal 108. Likewise, the reverse phase output switch circuit 170B comprises two output switches 176B and 178B both of each are also identical in structure to the circuitry of the output switch 170(1) shown in FIG. 3. Output switch 176B controls connection of DCC input power to output terminal 108 and output switch 178B controls connection of DCC input power to output terminal 106.

The switch output control circuit 190 comprises op amps 192 and 194, a power MOSFET IC Q10, capacitors C10, C11, C12 and diodes D14 and D15. The resistors R32 and R43 together with the op amps 192 and 194 form an output control circuit for stall-motor type switch machines, whereas the power MOSFET IC Q10 capacitors C10, C11, C12 and diodes D14 and D15 for an output control circuit for solenoid type switch machines. Since reverse switch machines are often used with a "reverse loop" that has a single switch at the beginning/end of the reverse loop, the device 100' allows the direction of the external switch machine to always align with the phase of the DCC output waveform. The controller 140 generates control signals to the switch output control circuit 190 so that the direction of the switch points of the external switch machine can be made to always align with the direction of the train on the track section, thus allowing complete automatic operation of the reversing loop. The device 100' also provides the ability to directly control the position of the switch points in an external switch machine via a NMRA DCC accessory command that the controller 140 detects and responds to when generating signals that control the switch output control circuit 190. The controller 140 responds to the DCC accessory command to generate the signals to control both the position of the switch points of the external switch machine and the phase DCC waveform at the output terminals 106 and 108 ensuring that these two parameters are always locked together as is required for automatic loop operation.

Operational amplifiers 192 and 194 along with their associated resistors are designed to drive a stall motor type of switch machine. The control signals to the amplifiers are arranged such that one of the operational amplifiers 192 and 194 has an output close to the positive supply voltage while the other of the operational amplifiers 192 and 194 has an output close to the ground voltage. This will maintain a voltage across the stall motor switch machine that is connected to the operational amplifiers 192 and 194 as is required by its operation. By exchanging the states of the control inputs, the outputs of the operational amplifiers 192 and 194 will exchange voltages thus reversing the direction of the voltage across the stall motor switch machine. This will cause the machine to change its position and then stall in the new position. By applying the appropriate control signals, the stall motor switch machine may be set to either position as desired.

Switch machines that use a dual coil arrangement to move the points require a short, high current pulse to operate. Capacitors C11 and C12, and diodes D14, and D15 form a conventional voltage doubler circuit that has an output voltage equal to approximately twice the input voltage. This voltage is used to charge capacitor C10 to a value approximately equal to twice the voltage across input terminals 102 and 104. Capacitor C10 is a large value capacitor, 3,300 μF for example, such that, once charged, will hold enough energy to operate the dual coil switch machine. The common lead of the dual coil switch machine is attached to the positive terminal of capacitor C10, while each individual coil lead is attached to one of the transistors in transistor circuit Q10. By selecting to turn on one or the other transistors of the transistor circuit Q10, the energy stored in capacitor C10 can be made to flow through one or the other of the switch machine coils, thus operating the switch. Once the energy in capacitor C10 has been discharged (usually in less than 1 second), the control transistor in Q10 may be turned off, allowing capacitor C10 to recharge for the next switch machine operation.

In operation, the controller 140 compares a voltage analog of the current measured by the current measuring circuits 130A and 130B. If the voltage exceeds the stored value in either of the current measuring circuits 130A or 130B, an over-current condition is detected. Upon detecting such a condition, the controller 140 executes a first control function to turn off the output switch that is presently on and then turns on the output switch that was off before the short. In this manner, the controller 140 reverses the polarity of the DCC waveform. Controller 140 then invokes the comparator again to make the current comparison between the voltage analog of the current measured by the current measuring circuits 130A and 130B. Subsequent to executing the first control function, if the controller 140 determines that the voltage analog of the current in both the current measuring circuits is below the stored trip limit value of the comparator then the reversing function eliminated the short-circuit condition and no further action is taken. Otherwise, if during this second comparison, the controller determines that the voltage analog of the measured current in either current measuring circuit 130A or 130B still exceeds the trip limit value, the controller 140 determines that there still is a short-circuit condition present and executes a second control function by which it supplies a trigger signal to both output switches 170A and 170B to turn them both off.

As described above previously, each output circuit 170A and 170B may be turned on or off by the action of an optical coupler 172 shown in FIG. 3. Control of the output switches 170A and 170B is then accomplished by simply turning on or off the input LEDs of the optical coupler associated with the desired switch. The optical coupler LED diodes are connected via a current limiting resistor R10 in FIG. 3 to the controller 5 volt supply 112. If the controller 140 outputs a high logic value, then the optical coupler LEDs have no current through them and the associated switch is off. If the controller asserts a low logic value, then current flows through the LEDs of the associated optical coupler and the switches connected to the optical coupler turn on.

There are some track layouts that have back-to-back reverse loops. In this case, power regulation devices 100' associated with each of the reverse loops may interfere with each other. In a reversing situation, both power regulation devices may detect the short that triggers the reversing action. However, both power regulation devices will then reverse, resulting in the perpetuation of the short. When each device tests whether the reversing action cleared the short, they will both detect a short current still flowing and will both conclude that a short is present and turn off. This action is as described above except that both devices 100' are now following the logic. In the back-to-back reverse loop configuration, normally programmed reversing sequence actually result in a shutdown of track power. This is undesirable. Accordingly, the controller 140 in the device 100' may be programmed to act as a slave unit that has a programmable reversing time delay so that multiple adjacent devices 100' reverse in sequence. The designated secondary device 100' may use, for example, a delay of 1 ms before confirming a short condition. If the short is confirmed after the delay, then the controller 140 simply executes the same control sequence to reverse or turn off the output as discussed above. When, after the 1 ms delay, the controller 140 does not confirm the presence of a short, then it simply takes no action.

This logic then corrects the conflict condition discussed previously. When a reversing condition occurs between two loops, the primary device 100' will immediately reverse the track polarity and relieve the short. Meanwhile, the secondary device 100' will do nothing for 1 ms. At the end of the 1 ms time, the secondary device will determine if the current is greater than its programmed short circuit current limit. Since the short was removed by the reversing action of the primary device 100' the secondary device will not see an over-current condition and will take no action. The track voltage will be correctly reversed and no conflict will occur. In the event that there is a reverse situation or a fault situation for the secondary device 100', it will behave as previously disclosed for a primary device except that all of its actions will be delayed by 1 ms as compared to a primary device 100' in the same circumstances.

Programming the power regulation device 100' In addition to the two accessory addresses described above in connection with device 100, the power regulation device 100' has a third accessory address used to control the output to the stall motor or dual coil switch machine outputs using normal DCC accessory commands for a switch, throw(off) or clear(on) command.

The programmable parameters described above in connection with power regulation device 100 are also supported by the power regulation device 100'.

Thus, the power regulation device 100' provides for a method for managing power supplied to a reversing loop track section of a model railway system, by monitoring at first and second input terminals a supply of power in the form of an alternating waveform that is supplied to a track section; detecting an over-current condition at least one of the first and second input terminals; upon detecting the over-current condition, reversing the polarity of the alternating waveform supplied to the reversing loop track section; subsequent to reversing, monitoring the power at the first and second input terminals; detecting whether the over-current condition still exists after reversing; and upon detecting that the over-current condition still exists after reversing, disconnecting said alternating waveform from the reversing loop track section.

Figure 6:
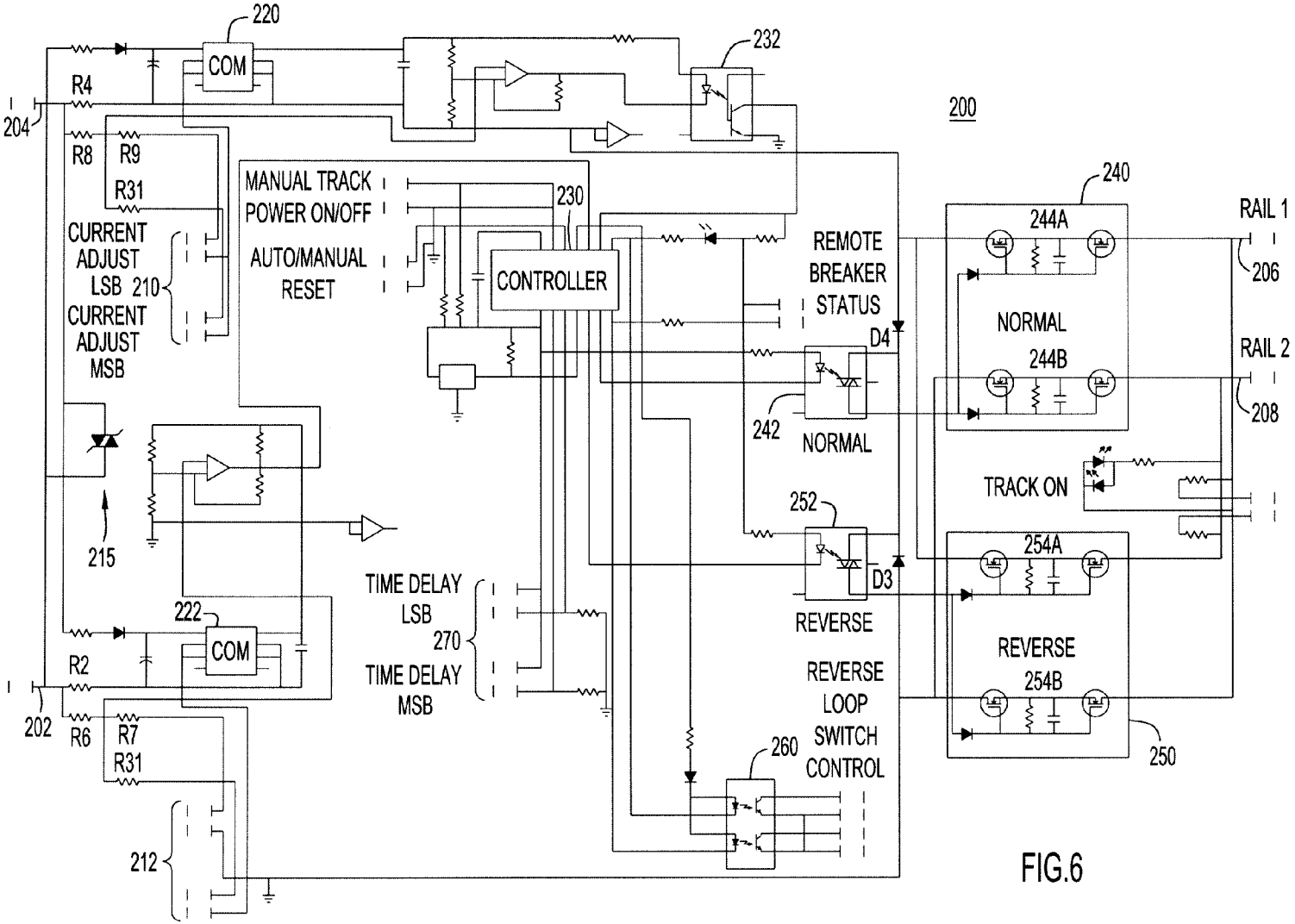
FIG. 6 is a schematic diagram of a power regulation device according to still another embodiment of the invention.

FIG. 6 illustrates a schematic diagram of a power regulation device 200 according to yet another embodiment of this invention. The functional blocks of the power regulation device of this embodiment are substantially the same as the devices 100 and 100', except for several basic differences. While the devices 100 and 100' use a transformer to sense the current and a software-based comparison to determine if the current is in excess of a desired limit, the device 200 uses a resistor to sense current and a hardware comparator to determine if the current exceeds the desired level. Specifically, resistors R2 and R4 are provided that are connected to input terminals 202 and 204 respectively. Resistors R2 and R4 are precision resistors that produce a voltage proportional to the current through them. This voltage is compared to a reference voltage produced by resistors R6, R7, R31 and jumpers 210 for resistor R2, and the reference voltage produced by resistors R8, R9, R33 and jumpers 212 for resistor R4. By installing different combinations of jumpers, different reference voltages are produced. These voltages in turn provide different trip limits for comparators 220 and 222. The outputs of the comparators 220 and 222 are connected to controller 230 which provides substantially the same response to an over-current condition as described above for controller 140 in the embodiments of FIGS. 3 and 5. An optical coupler 232 allows the logic state of comparator 220 to be conveyed to the controller 230 while translating the voltage level of DCC1 (at input terminal 204) to a value compatible with the ground reference of 230. Unlike preceding embodiments, the controller 230 does not respond to NMRA DCC commands. There is a clamp circuit 215 that is similar to the clamp circuit referred to above in connection with devices 100 and 100'.

The controller 230 is connected to, and controls a normal phase output switch circuit 240 and a reverse phase output switch circuit 250, via a corresponding optically-coupled silicon rectifier (SCR) circuit 242 and 252. These switches are connected to the output terminals 206 and 208 is much the same manner as the devices of the previous embodiments.

Normal phase output switch 240 comprises switch subcircuits 244A and 244B each comprises of a pair of MOSFETs, a resistor, a capacitor and a diode that is connected to gates of the MOSFETs. Reverse phase output switch 250 has switch subcircuits 254A and 254B which are identical to the subcircuits 244A and 244B. In this embodiment, the output switch is off if no current is supplied to the LED of its associated optically-coupled SCR 242 or 252, and conversely the output switch is on if current is supplied to its optically-coupled SCR 242 or 252. The controller 230 supplies the trigger current signal to the appropriate one of the optically-coupled SCR 242 or 252 in much the same manner as described in the previous embodiments.

The operation of each switch subcircuit is as follows, with subcircuit 244A used as an example. The resistor in the switch subscircuit acts to keep the source to gate voltage of the MOSFETs at 0 volts (switch off) when no current is supplied to the associated optically-coupled SCR 242. When the optically-coupled SCR 242 is turned on, current flows, for example, from input terminal 202 to diode D3, through the SCR output of the optical coupler 242, to diode D2 in output switch 240, through the capacitor in the switch subcircuit 244A, through the bulk body diode of the MOSFETs in subcircuit 244A and back to input terminal 204. This current flow has the effect of charging the capacitor of the subcircuit 244A which turns the switch composed of the two MOSFETs on. When the optically-coupled SCR 242 is turned off, the resistor in subcircuit 244A acts to discharge the capacitor in subcircuit 244A and hence turns the switch subcircuit 244A off. Operation of the other subcircuits is similar.

The device 200 does not have an output that can be connected directly to a switch machine. Instead, it is designed to provide a control input, via optical coupler 260, to a DCC accessory decoder, such the NCE Switch-It™ decoder. When the output track polarity is reversed, the outputs of optical coupler 260 are pulsed on and off which simulates the input from a manual pushbutton to the decoder. This action causes the accessory decoder to always track the polarity of the Rail 1 and Rail 2 outputs at output terminals 206 and 208, respectively.

Unlike the devices 100 and 100', the device 200 does not use a logarithmic amplifier. Since the log of the input current is not available in device 200, the controller 230 cannot execute the previously described "smart turn-on" algorithm. Instead, a set of jumpers on 270 are provided to select one of four possible time delays. For example, the four possible time delays are 10 ms, 20 ms, 30 ms, and 40 ms. These delays are the amount of time that the device 200 will hold the output on whether or not a short condition is detected. If a high inrush load is connected to the input terminals 202 and 204, as discussed above in connection with the previous embodiments, the device 200 will simply wait the programmed time delay after turning on before it determines if the current is in excess of the value set by jumpers 210 and 212 as discussed above. By carefully selecting the trip current and time delay, most high in-rush current loads may be started.

In all of the embodiments of the invention described herein, the output switches used to control isolation of the input alternating waveform comprise components that produce a very low on resistance in order to maximize the amount of voltage applied at the first and second input terminals reaches the rails of the track section via the first and second output terminals, and is not lost in the output switch. For example, the on resistance of the output switches may be on the order of 0.060 ohms.

When numerous trains are running in a layout, a user may configure the DCC power unit to supply all the power needs throughout the layout. Adding so-called "power districts" to the layout can be a help. By separating a layout into districts, it is possible to divide the total track power available into smaller, more manageable units.

Generally, there are two types of power districts: those that are circuit-breaker protected zones on the layout and those that have their own independent booster (also breaker protected). One way to determine where to place power districts is to evaluate the expected current draw, (Traffic), for each operating location on the layout. For example, a busy yard might have two switches, one or more trains on the arrival and departure tracks and another train or two passing the yard on the main section. If some or all of these trains have more than one locomotive, 10 to 15 current-drawing units may be competing for power in a fairly small area. By dividing a layout into power districts in this manner, and using a combination of boosters and circuit breakers, it is possible to make the most efficient use of available power on any mid-size or large-size layout.

As explained above, the power regulation device may have single breaker unit, a single reverser unit, or both. In addition, the device may include multiple breaker units and/or reverser units. A power regulation device comprising one breaker unit is suitable for use as a DCC circuit breaker for regulation of one power district (rated for 8 A). A power regulation device comprising two breaker units is suitable for use as a DCC circuit breaker for regulation of two power districts. A power regulation device comprising four breaker units is suitable for use as a DCC circuit breaker for regulation of four power districts.

In sum, a power regulation device is provided that is configured to trip instantaneously and reset quickly via a panel mount, toggle-switch-type reset with an on/off function. Installing the power regulation device in either power buss lead or track feeder group provides protection. In operation, the device may be used to create power districts within a railway system. For example, a small layout (e.g., 4'×8') may define one power district to which the power regulation device is connected via one lead of the mixer/booster output. A short on the layout (and thus within the district) trips a breaker within the power regulation device, preventing damage to the mixer, as well as minimizing interruption to the railway system. When the short is corrected, the device is reset and use of the railway can resume. The power regulation device may be configured to prevent its resetting if the short is not corrected. Even in a small railway system, a device including two breakers could be used to divide the power for the system, e.g., with half of the layout or one for the mainline and one for the yard or sidings. For larger railway systems, additional power districts would be defined to segregate active areas. Each power regulation device may be configured to handle enough current to run two to eight locomotives (depending on scale and the current draws of the locomotive).

The power regulator device concepts of the present invention may be adapted for use with model train systems that operates on 60 Hz (or 50 Hz in Europe, etc.) power, such as those made and sold under the Lionel brand. In this case, the power regulation device need not have DCC decoding capabilities because these types of train systems are not compliant with the DCC standard. The device would have a fixed configuration that cannot be changed other than by the jumper configurations disclosed herein to select the trip current. Moreover, the device would only provide the circuit breaking function and not the reversing function because a reverser has no use on a 3-rail model train system.

While the invention has been described in detail and with reference to specific embodiments thereof, it will be apparent to one skilled in the art that various changes and modifications can be made therein without departing from the spirit and scope thereof. For example, it is to be understood that terms such as "top", "bottom", "front", "rear", "side", "height", "length", "width", "upper", "lower", "interior", "exterior", "inner", "outer", and the like as may be used herein, merely describe points of reference and do not limit the present invention to any particular orientation or configuration. Thus, it is intended that the present invention covers the modifications and variations of this invention that come within the scope of the appended claims and their equivalents.

What is claimed is:

1. A power regulation device for a model railroad system, comprising:

first and second input terminals for connection to a supply of power in the form of an alternating waveform;

a first current measuring circuit coupled to the first and second input terminals that measures current flow from said first and second input terminals and generates a first current measurement signal representative thereof;

a controller coupled to said first current measuring circuit that analyzes said first current measurement signal to detect an undesired over-current condition at the first and second input terminals and in response generates a trigger signal;

first and second output terminals for connection to respective rails of a track section to connect the alternating waveform to said respective rails;

a switch circuit connected to said first and second input terminals and to said first and second output terminals to control connection of said alternating waveform from said first and second input terminals to said first and second output terminals, wherein said switch circuit is responsive to said trigger signal to disconnect said first and second output terminals from said first and second input terminals; and a power supply circuit that is connected to said first and second input terminals, wherein the power supply circuit rectifies the alternating waveform to produce power to operate circuits in said device for a period of time after loss of power due to a detected short circuit condition.

2. The device of claim 1, wherein said switch circuit comprises a plurality of switches each of which is connected to first and second output terminals that are in turn connected to a corresponding one of a plurality of track sections, wherein each of the plurality of output switches is responsive to the trigger signal to disconnect the alternating waveform from its associated first and second output terminals.

3. The device of claim 1, and further comprising a clamp circuit connected to said first and second input terminals and having an output coupled to said first current measuring circuit, wherein the clamp circuit prevents voltage spikes from passing through the device.

4. The device of claim 1, and further comprising an output monitor circuit that provides a visual indication of power being supplied to the track section by the first switch circuit.

5. A power regulation device for a model railroad system, comprising:

first and second input terminals for connection to a supply of power in the form of an alternating waveform;

a first current measuring circuit coupled to the first and second input terminals that measures current flow from said first and second input terminals and generates a first current measurement signal representative thereof;

a controller coupled to said first current measuring circuit that analyzes said first current measurement signal to detect an undesired over-current condition at the first and second input terminals and in response generates a trigger signal;

first and second output terminals for connection to respective rails of a track section to connect the alternating waveform to said respective rails;

a switch circuit connected to said first and second input terminals and to said first and second output terminals to control connection of said alternating waveform from said first and second input terminals to said first and second output terminals, wherein said switch circuit is responsive to said trigger signal to disconnect said first and second output terminals from said first and second input terminals;

wherein said switch circuit comprises at least one switch that is connected to receive the trigger signal from the controller, wherein the switch is responsive to the trigger signal to disconnect said first and second output terminals from the first and second input terminals so as to turn off supply of said alternating waveform to the track section; and wherein the switch of the switch circuit comprises an optical coupler, first and second transistors connected in a source-to-source configuration, a capacitor, a first diode and a Zener diode, wherein the capacitor and Zener diode are connected between the first and second transistors and the optical coupler, wherein the first input terminal is connected to said first diode and to said first output terminal, the second input terminal is coupled via said current measuring circuit to a drain of said first and second transistors, the first diode is connected between the optical coupler and the capacitor, and a drain of said second transistor is connected to said second output terminal, wherein said optical coupler is responsive to said trigger signal to turn off said first and second transistors thereby disconnecting the alternating waveform from said first and second output terminals.

6. A power regulation device for a model railroad system, comprising:

first and second input terminals for connection to a supply of power in the form of an alternating waveform;

a first current measuring circuit coupled to the first and second input terminals that measures current flow from said first and second input terminals and generates a first current measurement signal representative thereof;

a controller coupled to said first current measuring circuit that analyzes said first current measurement signal to detect an undesired over-current condition at the first and second input terminals and in response generates a trigger signal;

first and second output terminals for connection to respective rails of a track section to connect the alternating waveform to said respective rails;

a switch circuit connected to said first and second input terminals and to said first and second output terminals to control connection of said alternating waveform from said first and second input terminals to said first and second output terminals, wherein said switch circuit is responsive to said trigger signal to disconnect said first and second output terminals from said first and second input terminals; and a logarithmic amplifier circuit having an input connected to receive said first current measurement signal produced by the first current measuring circuit and producing an output signal that is a natural logarithm of said first current measurement signal and indicates a measure of current at said first and second input terminals over several magnitude intervals.

7. The device of claim 6, wherein the controller receives as input a signal derived from the output signal produced by the logarithmic amplifier, wherein the controller analyzes said signal derived from the output signal of the logarithmic amplifier and said first current measurement signal to determine when a true over-current condition exists and in response generates said trigger signal.

8. The device of claim 7, wherein said controller generates said trigger signal when it determines that there is a true over-current condition when said first current measurement signal and said signal that is a natural logarithm of the current measurement signal indicate that current at said first and second input terminals is high and relatively constant and said controller does not generate said trigger signal when it determines that said first current measurement signal and said signal that is a natural logarithm of the first current measurement signal indicate an current is high but decreases.

9. The device of claim 7, wherein upon turning on power to said first and second output terminals, said controller analyzes the first current measurement signal and said signal produced by said logarithmic amplifier to prevent turning off power to said first and second output terminals as a result of a temporary surge load.

10. The device of claim 7, and further comprising a block detector output, wherein the controller compares said signal derived from the output signal produced by the logarithmic amplifier with a limit value and when said signal is greater than said limit value said controller activates a signal supplied to said block detector output and otherwise does not activate said signal supplied to said block detector output.

11. A power regulation device for a model railroad system, comprising:

first and second input terminals for connection to a supply of power in the form of an alternating waveform;

a first current measuring circuit coupled to the first and second input terminals that measures current flow from said first and second input terminals and generates a first current measurement signal representative thereof;

a controller coupled to said first current measuring circuit that analyzes said first current measurement signal to detect an undesired over-current condition at the first and second input terminals and in response generates a trigger signal;

first and second output terminals for connection to respective rails of a track section to connect the alternating waveform to said respective rails;

a switch circuit connected to said first and second input terminals and to said first and second output terminals to control connection of said alternating waveform from said first and second input terminals to said first and second output terminals, wherein said switch circuit is responsive to said trigger signal to disconnect said first and second output terminals from said first and second input terminals; and one or more boost outputs dedicated to supplying a boosted output current to low current capability devices, wherein the controller controls turns on the supply of said boosting output current to said boost outputs for a time interval to start surge load charging and then turns off the boosting output current for a time interval to allow low current capability devices to recover.

12. A power regulation device for a model railroad system, comprising:

first and second input terminals for connection to a supply of power in the form of an alternating waveform;

a first current measuring circuit coupled to the first and second input terminals that measures current flow from said first and second input terminals and generates a first current measurement signal representative thereof;

a controller coupled to said first current measuring circuit that analyzes said first current measurement signal to detect an undesired over-current condition at the first and second input terminals and in response generates a trigger signal;

first and second output terminals for connection to respective rails of a track section to connect the alternating waveform to said respective rails;

a switch circuit connected to said first and second input terminals and to said first and second output terminals to control connection of said alternating waveform from said first and second input terminals to said first and second output terminals, wherein said switch circuit is responsive to said trigger signal to disconnect said first and second output terminals from said first and second input terminals; and a photo sensor input for connection to a photo sensor device, wherein the controller is programmable to respond to a photo sensor output signal at the photo sensor input representing a level of illumination of said photo sensor and to generate said trigger signal when said photo sensor output signal exceeds a threshold indicative of presence of an object in the field of view of the photo sensor.

13. The device of claim 12, wherein the alternating waveform contains digital control information for use by said controller, where the controller maintains said first and second output terminals disconnected from said first and second input terminals until an arming command in said alternating waveform is supplied to said controller upon which said controller disables the triggering signal so that the switch connects to said first and second output terminals.

14. A power regulation device for a model railroad system, comprising:

first and second input terminals for connection to a supply of power in the form of an alternating waveform;

a first current measuring circuit coupled to the first and second input terminals that measures current flow from said first and second input terminals and generates a first current measurement signal representative thereof;

a controller coupled to said first current measuring circuit that analyzes said first current measurement signal to detect an undesired over-current condition at the first and second input terminals and in response generates a trigger signal;

first and second output terminals for connection to respective rails of a track section to connect the alternating waveform to said respective rails;

a switch circuit connected to said first and second input terminals and to said first and second output terminals to control connection of said alternating waveform from said first and second input terminals to said first and second output terminals, wherein said switch circuit is responsive to said trigger signal to disconnect said first and second output terminals from said first and second input terminals; and wherein said controller comprises a memory that is user programmable and which stores values for operational parameters including an over-current trip value, wherein said controller analyzes said first current measurement signal with respect to said over-current trip value to determine whether said over-current condition is occurring.

15. A power regulation device for a model railroad system, comprising:

first and second input terminals for connection to a supply of power in the form of an alternating waveform;

a first current measuring circuit coupled to the first and second input terminals that measures current flow from said first and second input terminals and generates a first current measurement signal representative thereof;

a controller coupled to said first current measuring circuit that analyzes said first current measurement signal to detect an undesired over-current condition at the first and second input terminals and in response generates a trigger signal;

first and second output terminals for connection to respective rails of a track section to connect the alternating waveform to said respective rails;

a first switch circuit connected to said first and second input terminals and to said first and second output terminals to control connection of said alternating waveform from said first and second input terminals to said first and second output terminals, wherein said first switch circuit is responsive to said trigger signal to disconnect said first and second output terminals from said first and second input terminals; and a second switch circuit connected to the first and second input terminals and the first and second output terminals;

wherein said controller controls said first and second switch circuits to accommodate a reversing function for a reversing loop track section, such that said first switch circuit controls connection of said alternating waveform to the first and second output terminals in phase with the alternating waveform, and such that said second switch circuit controls connection of said alternating waveform to the first and second output terminals in reverse of the phase of the alternating waveform at the first and second input terminals.

16. The device of claim 15, and further comprising a second current measuring circuit, the first current measuring circuit connected to the first input terminal and the second current measuring circuit connected to the second input terminal such that said first current measurement signal represents a measure of current from the first input terminal and the second current measuring circuit connected to said second input terminal generates a second current measurement signal representing a measure of current from said second input terminal, wherein the controller is connected to the first and second current measuring circuits and when the controller determines that either of the first and second current measurement signals indicate an over-current condition, said controller executes a first control function of said the first and second switch circuits so as to turn off one of the first and second switch circuits that had been turned on and to turn on one the other of the first and second switch circuits that had been turned off thereby reversing the polarity of the alternating waveform to the output terminals.

17. The device of claim 16, wherein subsequent said first control function, said controller analyzes the first and second current measurement signals to determine whether the over-current condition was eliminated as a result of the reversing the polarity of the alternating waveform to the output terminals.

18. The device of claim 17, wherein subsequent said first control function, when said controller analyzes the first and second current measurement signals and determines that said over-current condition remains, said controller controls a trigger signal to turn off both the first and second switch circuits.

19. The device of claim 18, and further comprising one or more switch machine control outputs and a switch output control circuit connected to said controller and said switch control outputs, wherein said switch output control circuit generates switch control signals that are suitable to cause a switch machine connected to said switch machine control outputs to be in alignment with a phase of the alternating waveform supplied to the first and second output terminals.

20. A power regulation device for a model railroad system, comprising:

first and second input terminals for connection to a supply of power in the form of an alternating waveform;

a first current measuring circuit coupled to the first and second input terminals that measures current flow from said first and second input terminals and generates a first current measurement signal representative thereof;

a controller coupled to said first current measuring circuit that analyzes said first current measurement signal to detect an undesired over-current condition at the first and second input terminals and in response generates a trigger signal;

first and second output terminals for connection to respective rails of a track section to connect the alternating waveform to said respective rails;

a first switch circuit connected to said first and second input terminals and to said first and second output terminals to control connection of said alternating waveform from said first and second input terminals to said first and second output terminals, wherein said first switch circuit is responsive to said trigger signal to disconnect said first and second output terminals from said first and second input terminals; and wherein the first switch circuit is configured to produce a very low on resistance for said first switch circuit in order to maximize the amount of voltage applied at the first and second input terminals reaches the rails of the track section via the first and second output terminals.

21. A power regulation device for a model railroad system, comprising:

first and second input terminals for connection to a supply of power in the form of an alternating waveform;

a first current measuring circuit coupled to the first and second input terminals that measures current flow from said first and second input terminals and generates a first current measurement signal representative thereof;

a controller coupled to said first current measuring circuit that analyzes said first current measurement signal to detect an undesired over-current condition at the first and second input terminals and in response generates a trigger signal;

first and second output terminals for connection to respective rails of a track section to connect the alternating waveform to said respective rails;

a switch circuit connected to said first and second input terminals and to said first and second output terminals to control connection of said alternating waveform from said first and second input terminals to said first and second output terminals, wherein said switch circuit is responsive to said trigger signal to disconnect said first and second output terminals from said first and second input terminals; and wherein the controller is programmable to automatically reset the first switch circuit and thereby connect the alternating waveform to the first and second output terminals a programmable period of time after controlling said first switch circuit to disconnect the first and second output terminals from the first and second input terminals.

22. A power regulation device for a model railroad system, comprising:

first and second input terminals for connection to a supply of power in the form of an alternating waveform;

a first current measuring circuit coupled to the first and second input terminals that measures current flow from said first and second input terminals and generates a first current measurement signal representative thereof;

a controller coupled to said first current measuring circuit that analyzes said first current measurement signal to detect an undesired over-current condition at the first and second input terminals and in response generates a trigger signal;

first and second output terminals for connection to respective rails of a track section to connect the alternating waveform to said respective rails;

a switch circuit connected to said first and second input terminals and to said first and second output terminals to control connection of said alternating waveform from said first and second input terminals to said first and second output terminals, wherein said switch circuit is responsive to said trigger signal to disconnect said first and second output terminals from said first and second input terminals; and a reset switch connected to said controller, wherein said controller monitors said reset switch and resets the first switch circuit only when said reset switch is activated.

23. A power regulation device for a model railroad system, comprising:

first and second input terminals for connection to a supply of power in the form of an alternating waveform;

a first current measuring circuit coupled to the first and second input terminals that measures current flow from said first and second input terminals and generates a first current measurement signal representative thereof;

a controller coupled to said first current measuring circuit that analyzes said first current measurement signal to detect an undesired over-current condition at the first and second input terminals and in response generates a trigger signal;

first and second output terminals for connection to respective rails of a track section to connect the alternating waveform to said respective rails;

a switch circuit connected to said first and second input terminals and to said first and second output terminals to control connection of said alternating waveform from said first and second input terminals to said first and second output terminals, wherein said switch circuit is responsive to said trigger signal to disconnect said first and second output terminals from said first and second input terminals; and wherein the controller is responsive to a digital command contained in the alternating waveform to automatically control said first switch circuit to connect or disconnect the alternating waveform from the first and second output terminals.

24. A method for managing power supplied to a track section of a model railway system, comprising:

monitoring at input terminals a supply of power in the form of an alternating waveform that is supplied to a track section, wherein monitoring further comprises measuring current associated with said alternating waveform at said input terminals, generating a current measurement signal representing measurement of said current and generating a signal that is a natural logarithm of said current measurement signal and which indicates a measure of current at said input terminals over multiple magnitude intervals;

analyzing said current measurement signal and said signal that is a natural logarithm of said current measurement signal to to detect an undesired over-current condition at the input terminals; and disconnecting said alternating waveform to said track section when the undesired over-current condition is detected.

25. The method of claim 24, wherein said analyzing comprises determining that the over-current condition exists when said current measurement signal and said signal that is a natural logarithm of said current measurement signal indicate that current at said input terminals is high and relatively constant and determining that the over-current condition does not exist when said current measurement signal and said signal that is a natural logarithm of said current measurement signal indicate that current at said input terminals is high but decreases.

26. A method for managing power supplied to a reversing loop track section of a model railway system, comprising:

monitoring at first and second input terminals a supply of power in the form of an alternating waveform that is supplied to a track section;

detecting an over-current condition at least one of the first and second input terminals;

upon detecting the over-current condition, reversing the polarity of the alternating waveform supplied to said reversing loop track section;

subsequent to said reversing, monitoring the power at the first and second input terminals;

detecting whether the over-current condition still exists after said reversing; and upon detecting that the over-current condition still exists after said reversing, disconnecting said alternating waveform from the reversing loop track section.

27. The method of claim 26, and further comprising controlling a switch machine to be in alignment with a phase of the alternating waveform.

* * * * *

UNITED STATES PATENT AND TRADEMARK OFFICE

CERTIFICATE OF CORRECTION

PATENT NO. : 7,810,435 B2
APPLICATION NO. : 11/733850
DATED : October 12, 2010
INVENTOR(S) : Lawrence C. Maier It is certified that error appears in the above-identified patent and that said Letters Patent is hereby corrected as shown below:

Column 13, line 59, replace “condition at least” with -- condition at at least --;

Column 22, line 62, replace “resets the first switch” with -- resets the switch --;

Column 23, line 24, replace “said first switch” with -- said switch --; and

Column 24, line 23, replace “condition at least” with -- condition at at least --.

Signed and Sealed this
Twenty-ninth Day of November, 2011

David J. Kappos

David J. Kappos
*Director of the United States Patent and Trademark Office*